United States Patent [19]

Hofmann

[11] 4,418,677

[45] Dec. 6, 1983

[54] ALTERNATOR FOR IGNITION SYSTEM AND AUXILIARY POWER

[75] Inventor: Gloris R. Hofmann, Fond du Lac, Wis.

[73] Assignee: Brunswick Corporation, Skokie, Ill.

[21] Appl. No.: 317,827

[22] Filed: Nov. 3, 1981

[51] Int. Cl.[3] ..... F02P 1/02; F02P 5/04; F02P 3/06

[52] U.S. Cl. ..... 123/599; 123/602; 123/605

[58] Field of Search ..... 123/599, 602, 418, 655, 123/149 D, 605; 310/74, 70

[56] References Cited

U.S. PATENT DOCUMENTS

| | | | |
|---|---|---|---|
| 3,465,739 | 9/1969 | Burson | 123/599 |
| 3,678,913 | 7/1972 | Zimmermann et al. | 123/599 |
| 3,880,132 | 4/1975 | Whatley, Jr. | 123/599 |
| 3,955,550 | 5/1976 | Carlsson | 123/599 |
| 3,961,618 | 6/1976 | Swift | 123/602 |
| 4,061,121 | 12/1977 | MacLeod | 123/599 |
| 4,111,174 | 9/1978 | Fitzner et al. | 123/602 |
| 4,160,435 | 7/1979 | Sloder | 123/599 |
| 4,213,436 | 7/1980 | Burson | 123/599 |
| 4,259,938 | 4/1981 | Johansson | 123/599 |

FOREIGN PATENT DOCUMENTS

| | | | |
|---|---|---|---|
| 732888 | 11/1933 | United Kingdom | 123/599 |

*Primary Examiner*—Raymond A. Nelli
*Attorney, Agent, or Firm*—O. T. Sessions

[57] ABSTRACT

The invention provides an alternator driven by an engine crankshaft (11). A stator mounted on the engine (10) includes circumferentially spaced power coils (19) lying in the plane of and radially inward of the power magnets (20) mounted on the engine flywheel (12). Ignition coils (18) are mounted circumferentially spaced from the power magnets (20), but axially offset therefrom to couple with the fringe flux of the power magnets, thus allowing a high output from the power coils (19) without overloading the ignition coils (18).

4 Claims, 4 Drawing Figures

ALTERNATOR FOR IGNITION SYSTEM AND AUXILIARY POWER

DESCRIPTION

1. Technical Field

This invention relates to an electrical alternator apparatus for internal combustion engines and, more particularly, to such apparatus for powering an ignition system and auxiliary electrical equipment.

2. Background Art

Internal combustion engine powered devices such as outboard motors, snowmobiles, lawn tractors, and similar devices frequently use capacitor discharge ignition systems and have auxiliary electrical equipment such as lights, starters, and batteries. Further, the different nature of the ignition system and the auxiliary equipment generally place distinctly different requirements on the power source. Space limitations in such applications require a compact, lightweight construction for the electrical power source. Consequently an alternator may frequently be incorporated into the flywheel structure of the engine to generate electrical power.

One prior alternator, disclosed in U.S. Pat. No. 4,160,435, uses two sets of magnets mounted on the flywheel, axially spaced apart, and coupled with two sets of axailly spaced stator coils. This arrangement thus provides two axially spaced alternators, one to power the engine's ignition system and another to provide auxiliary power.

Other alternators have used a single set of magnets on the flywheel coupled with two sets of stator coils in the same plane to power the ignition system and to provide auxiliary power. The output of the auxiliary power coils in such systems has been limited, since increasing magnet size to increase power will overload the ignition power coils.

DISCLOSURE OF INVENTION

The invention provides an alternator apparatus for supplying electrical power to both a capacitor ignition system for an internal combustion engine and to a separate auxiliary power load. A plurality of circumferentially spaced magnets are mounted on an engine driven rotor and all lie in a plane perpendicular to the axis of the rotor. A power coil means, which may include a plurality of circumferentially spaced power coils, is secured in radial alignment with the magnets while an ignition coil means is coupled to the fringe flux of the magnets, possibly by having at least two ignition coils axially offset from the plane of the magnets. This arrangement permits the use of stronger magnets without overloading the ignition circuits.

By offsetting two ignition coils to opposite sides of the plane of the magnets two ignition coils can occupy the same circumferential space required by one, thus allowing space for an additional power coil. The coils may still be compactly placed within the circle of the magnets.

Preferably, the magnets are mounted on the engine's flywheel and the coil means includes a core having radial poles for both the ignition and power windings.

The invention thus provides a compact alternator power source for an internal combustion engine which permits increased power output for auxiliary loads.

BEST MODE FOR CARRYING OUT THE INVENTION

Figure 1:
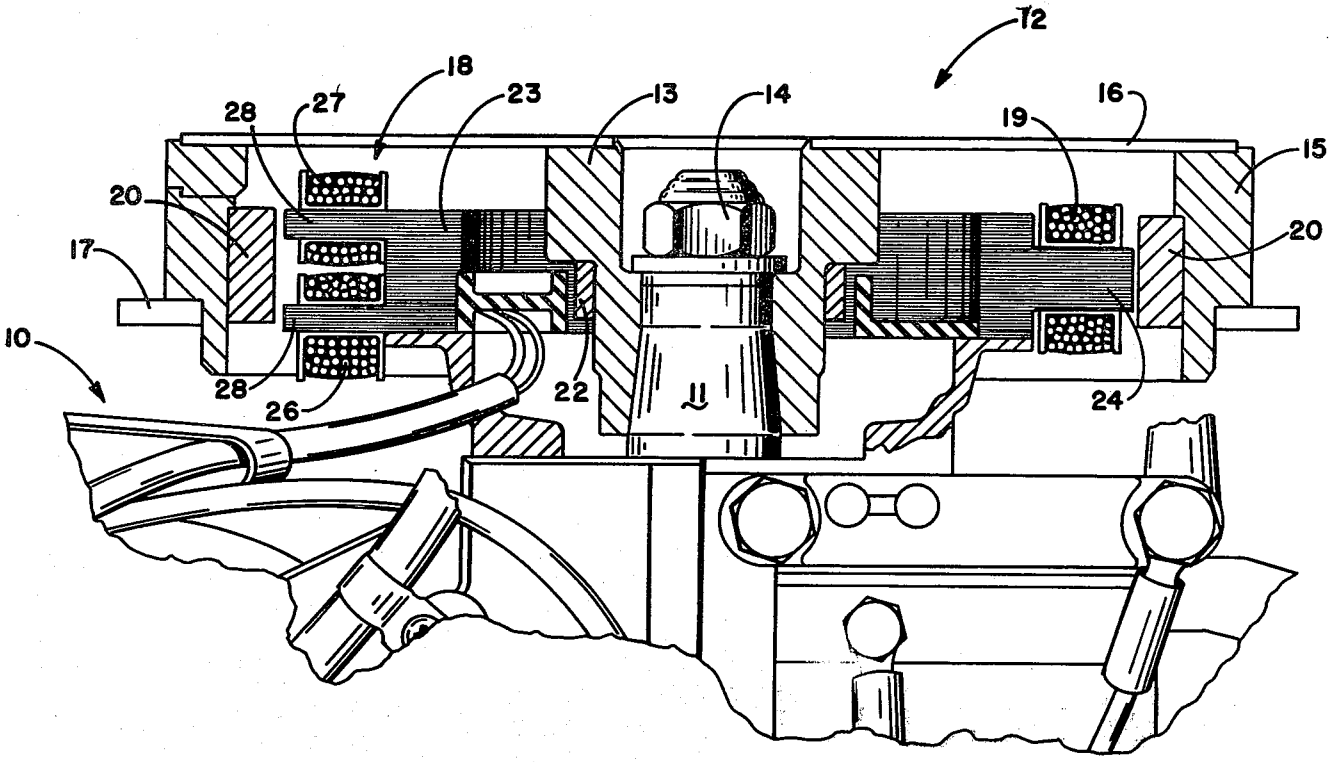
FIG. 1 is partial sectional view of an alternator apparatus according to the invention.

Shown in FIG. 1 of the drawings is the upper portion of an outboard motor engine 10. The engine 10 is of any suitable construction such as a two-cycle internal combustion engine widely employed in the outboard motor industry, and in the preferred embodiment is a large multi-cylinder outboard motor engine having six cylinders in a V arrangement. The engine 10 has a vertical crankshaft 11 with a flywheel assembly 12 attached at the upper end and is connected by any suitable means to drive a propeller, not illustrated.

The flywheel assembly 12 is attached to the upper end of the crankshaft 11 to reduce the fluctuation in rotational speed of the crankshaft 11. The flywheel assembly 12 includes a central hub 13, attached to the output shaft 11 by a nut 14 and key, not illustrated. An outer rim 15 is connected to the hub 13 by a plate 16 which is attached to both the rim 15 and the hub 13. A ring gear 17 attached to the outer periphery of the flywheel rim 15 may be selectively engaged by a gear driven by an electric motor, not illustrated, for starting the engine 10.

Generally, in the preferred embodiment, an alternator is mounted within the structure of the flywheel assembly 12. The alternator includes a set of ignition stator coils 18 and a set of power stator coils 19, both fixed to the engine 10. Six radially polarized power magnets 20 are fixed about the inner circumference of the flywheel rim 15 to generate electrical power in the coils as the flywheel turns.

The ignition coils 18 are connected to a capacitor discharge ignition unit 21 to supply power for charging the power capacitors. The capacitor discharge ignition unit 21 may be of any suitable type and typically will include a trigger coil to generate timed trigger pulses to control the discharge of the capacitors and thus the firing of the spark plugs. In the embodiment illustrated, the trigger coil, not illustrated, is positioned adjacent the flywheel hub and is coupled with magnets 22 mounted on the hub 13 to generate the timed trigger pulses.

In the preferred embodiment, both the ignition coils 18 and the power coils 19 are mounted on radial poles extending outwardly from a single laminated iron core 23. The core 23 is supported on the engine block with the crankshaft 11 projecting upward therethrough. All of the ten power coils 19 lie in a single plane perpendicular to the crankshaft axis and coincident with the plane in which the power magnets 20 lie. The poles 24 supporting the power coils 19 each terminate in a T-shaped pole shoe 25 having a slightly curved outer radius concentric with the crankshaft 11 and flywheel 12 to couple with the power magnets 20 across a small air gap and reduce the leakage flux. Each of the power coils 19 carried on the poles 24 has twenty six turns of seventeen gage copper wire.

The four ignition coils include two low speed coils 26 and two high speed coils 27. The low speed coils have a very large number of turns of fine wire, 15,000 turns of 42 gage wire in the preferred embodiment, while the high speed coils have a substantially smaller number of turns of heavier wire, 2,000 turns of 35 gage wire in the preferred embodiment. Each of the low speed coils 26 is connected in parallel with one of the high speed coils 27 to effectively charge the power capacitors, as shown in U.S. Pat. No. 3,874,349 to Fitzner. The four ignition charging coils 18 are arranged on four poles 28 formed on the axial edges of the stator core 23. With two coils occupying each of two circumferentially spaced positions, the four ignition charging coils 18 occupy the same circumferential space as two of the power cells, thus allowing additional space for the power coils. Further, with the ignition charging coils axially offset from the plane of the magnets and power coils, the ignition charging coils are coupled to the fringe flux of the power magnets 20. Thus more powerful magnets may be used to increase the output of the power coils without overloading the ignition coils 18.

Figure 2:
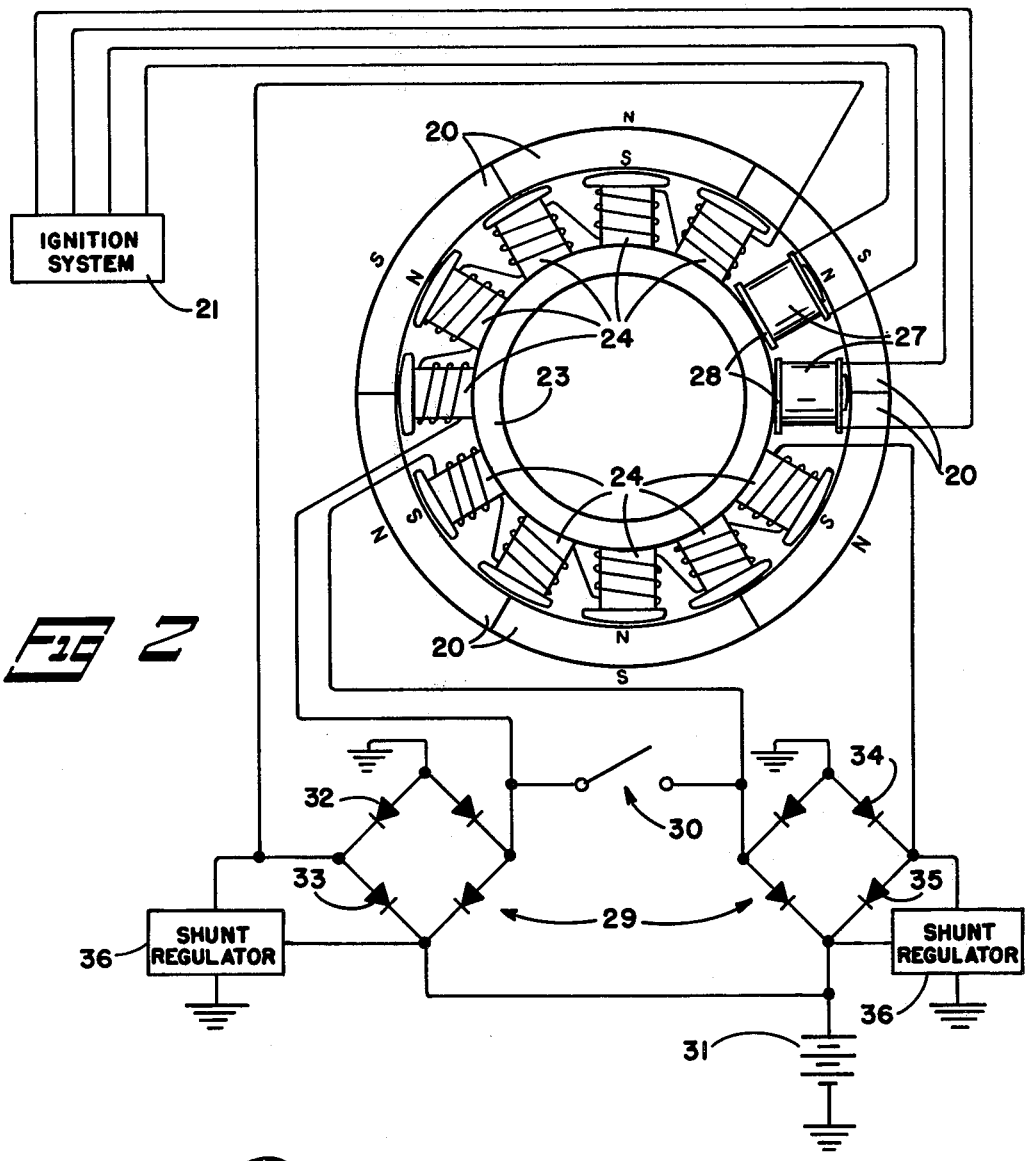
FIG. 2 is a top view of the stator and includes a schematic diagram of the power circuit.

As most clearly seen in FIG. 2, the power coils 19 are connected in two groups of five coils, with the coils in each group connected in electrical series. In the preferred embodiment each group of power coils is connected to a bridge circuit 29 made up of four diodes to provide full wave rectification. A switch 30 provided between the groups of coils allows them to be connected to the electrical load, represented by the battery 31 in FIG. 2, in either series or parallel relationship. With the switch 30 open as shown in FIG. 2, the groups of coils are connected in parallel with each bridge circuit 29 supplying direct current to the battery 31. With the switch 30 closed, the coils are effectively connected in series and the diodes 32, 33, 34 and 35 serve as a bridge circuit to rectify the current generated. A pair of shunt type voltage regulators 36, such as that described in the U.S. patent application of Staerzl, Ser. No. 06-059,054, filed on July 19, 1979 and assigned to the same assignee as this application, are connected across the bride rectifier circuits 29 to provide regulated power to charge the battery 31.

Figure 3:
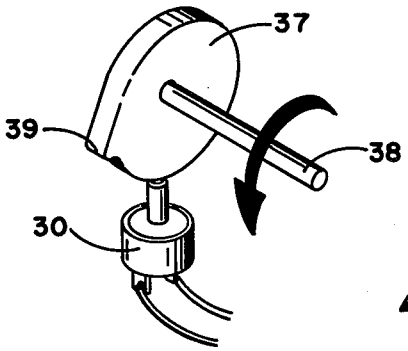
FIG. 3 is a detail drawing of the cam operated switch employed in the invention.
Figure 4:
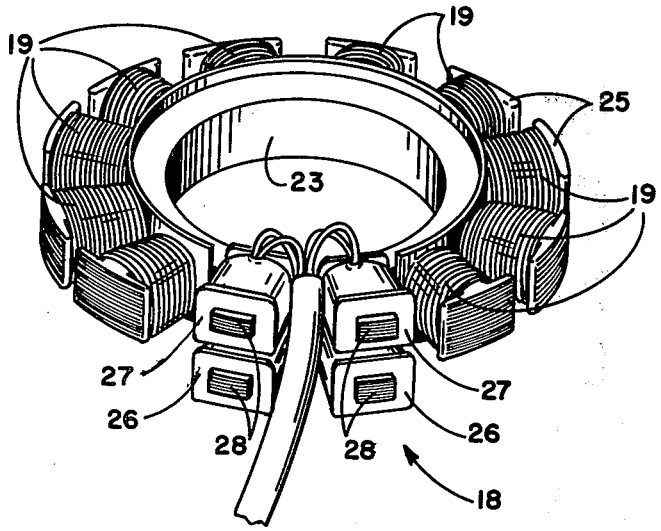
FIG. 4 is a perspective view of the stator incorporated in the invention.

The switch 30 of the preferred embodiment is actuated by a cam 37 driven by the engine's throttle linkage 38. The cam lobe 39 holds the switch 30 closed below a predetermined throttle setting as most clearly shown in FIG. 3. By switching the power coils 19 from a series connection at low speeds to a parallel connection at high speed, the higher output of the series connected coils at low speed can be utilized along with the higher output of the parallel connected coils at higher speeds.

I claim:

1. An alternator apparatus for supplying electrical power to a capacitor discharge ignition system of an internal combustion engine and for supplying electrical power to a separate power load, said alternator apparatus comprising:

(A) an engine driven flywheel mounted for rotation on said engine, said flywheel including a circumferential flange;

(B) a plurality of circumferentially spaced magnets mounted on the flange of said flywheel and lying in a common plane; and (C) a stator assembly mounted on said engine concentrically with said flywheel and radially inward of said flange, said stator assembly including (1) a circular magnetic core having a plurality of circumferentially spaced radial power poles lying in the plane of said magnets and at least two radial ignition poles offset from said plane, (2) power windings mounted on each of said power poles, and (3) ignition windings on each of said ignition poles, said ignition windings including a high speed winding and a low speed winding with said high speed winding having a substantially smaller number of turns of heavier wire than said low speed winding, all of said windings responding to the magnetic field created by said magnets to generate electrical outputs.

2. The alternator apparatus defined in claim 1 wherein said ignition poles include at least two ignition poles offset to opposite sides of said plane and axially aligned.

3. The alternator apparatus defined in claim 2 wherein said power windings include substantially fewer turns of heavier wire than does said high speed winding.

4. The alternator apparatus defined in claim 3 wherein each of said power poles include a T-shaped pole shoe adjacent said magnets.

* * * * *